US006622958B1

(12) United States Patent
Luomi et al.

(10) Patent No.: US 6,622,958 B1
(45) Date of Patent: Sep. 23, 2003

(54) METHOD FOR REELING UP

(75) Inventors: Seppo Luomi, Järvenpää (FI); Janne Veräjänkorva, Espoo (FI); Esa Aalto, Hyvinkää (FI); Timo Rautakorpi, Espoo (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/913,037

(22) PCT Filed: Feb. 4, 2000

(86) PCT No.: PCT/FI00/00078

§ 371 (c)(1),
(2), (4) Date: Aug. 8, 2001

(87) PCT Pub. No.: WO00/47502

PCT Pub. Date: Aug. 17, 2000

(30) Foreign Application Priority Data

Feb. 8, 1999 (FI) ..... 990234

(51) Int. Cl.[7] ..... B65H 18/26; B65H 23/198

(52) U.S. Cl. ..... 242/541.1; 242/413.5; 242/541.3; 242/541.7

(58) Field of Search ..... 242/541.1, 541.4, 242/541.5, 541.6, 541.7, 541.3, 413.5

(56) References Cited

U.S. PATENT DOCUMENTS 4,883,233 A * 11/1989 Saukkonen et al. ..... 242/541.3
5,251,835 A * 10/1993 Kyytsonen ..... 242/541.1
5,437,417 A * 8/1995 Kammann ..... 242/541.1
5,690,298 A * 11/1997 Ruck ..... 242/541.6
5,848,756 A * 12/1998 Sollinger et al. ..... 242/541.4
5,938,144 A * 8/1999 Kaipf et al. ..... 242/541.1
6,402,081 B1 * 6/2002 Rautakorpi et al. ..... 242/541.5

FOREIGN PATENT DOCUMENTS

| | | |
|---|---|---|
| DE | 1101938 | 3/1961 |
| EP | 0483092 | 4/1992 |
| WO | 9942392 | 8/1999 |

* cited by examiner

*Primary Examiner*—John M. Jillions
(74) *Attorney, Agent, or Firm*—Steinberg & Raskin, P.C.

(57) ABSTRACT

The invention relates to a method for reeling up, in which a paper web or the like is continuously reeled on a reeling core. The formation of the paper reel is controlled at least by means of an actuator (6) of the reeling core (4), advantageously by means of a centre-drive, an actuator (3) of a primary surface drive device (2) of the paper reel, and a nip load (N1) effective between the outer perimeter of a paper reel (5) formed on the reeling core (4) and the outer perimeter of the primary surface drive device (2) of the paper reel, said nip load being produced by means of an actuator (10), a so-called nip load device. According to the invention the torque ($M_{rs}$) produced by the actuator (3) of the primary surface drive device (2) of the paper reel is selected to be smaller than the sum ($\Sigma M_i$) of the torque values produced by the other actuators driving the paper reel that is being formed.

10 Claims, 1 Drawing Sheet

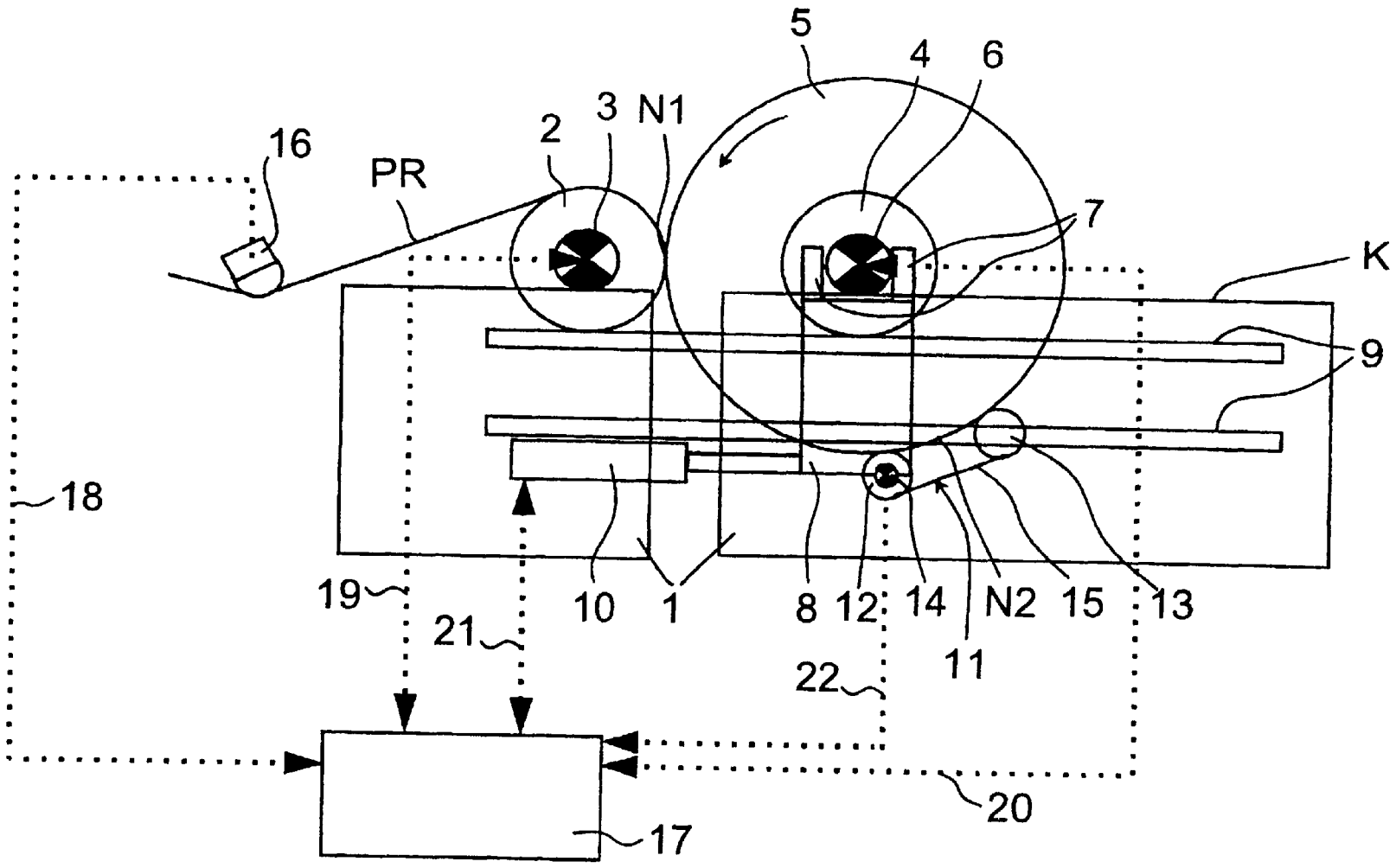
K
9
13
7
15
6
N2
20
11
4
14
12
22
5
8
1
N1
17
3
10
2
21
PR
19
16
18

METHOD FOR REELING UP

FIELD OF THE INVENTION

The invention relates to a method for reeling up, in which a paper web or the like is continuously reeled on a reeling core, wherein the formation of the paper reel is controlled at least by means of

- an actuator of the reeling core, advantageously by means of a centre-drive,
- an actuator of a primary surface drive device of the paper reel, advantageously by means of a centre-drive, and
- a nip load effective between the outer perimeter of the paper reel formed on the reeling core and the outer perimeter of the primary surface drive device of the paper reel the nip load being produced by means of an actuator, a so-called nip load device.

BACKGROUND OF THE INVENTION

As for the state of art, reference is made to the publication EP-483092, which discloses a centre-drive assisted reel-up. In addition, with regard to the state of art, it can be stated that the document WO-A-99/42392 discloses a method for reeling up, in which the reeling is controlled by adjusting the torque in the centre-drives. This, however, takes place in a manner which is not described in more detail.

In particular, the control of the drives of the reel-up in a paper machine takes place in such a manner that the speed of rotation of the primary surface drive device of the paper reel is adjusted so that the desired web tension is maintained between the reel-up and the preceding machine part (e.g. a drying section or a machine calender) exerting tensile stress on the paper web, and the torque of the drive of the reeling core is adjusted in such a manner that a suitable torque compensating the low speed of the mass of the paper reel that is being formed is thereby maintained. The adjustment of the torque is based on empirical information and the torque is changed in accordance with predetermined guidelines when the reeling up process proceeds to the reeling core. The tension of the paper web can be utilized to affect the density of the paper reel that is being formed. However, the act of increasing the tension of the paper web i.e. the act of increasing the tension difference for the primary surface drive device of the reel results in an increasing risk of paper web breaks, and possibly also causes stretching which otherwise impairs the properties of paper.

Thus, the solution of prior art is clearly limited in view of the overall control of the reeling up process. The present technology, for example the increased web speeds, set even higher demands for the methods for adjusting the process. The preset control of the centre torque does not take into account the real needs of the manufacturing process actively or in real time and neither does it take into account the possible changes occurring in the process during the reeling up. In particular, this applies to such interference situations which could be handled by means of a better control of the paper web, but which in the control according to the present state of art result in breaks in the paper web.

OBJECTS AND SUMMARY OF THE INVENTION

It is an aim of the present invention to eliminate the above-presented problems to a large extent thereby improving the state of art prevailing in the field. By means of the method according to the invention, it is possible to affect the formation of the paper reel in the reel-up when the reeling up process proceeds, and to produce such changes in the reeling up which eliminate the web break otherwise produced in connection with conventional methods. Thus, by means of the invention it is also possible to attain advantages while runnability becomes more reliable and continuity is improved therein.

To attain the above-described objectives, the method according to the invention is primarily characterized in that the torque produced by means of the actuator of the primary surface drive device of the paper reel is selected so that it is smaller than the sum of the torque values produced by the actuators driving the paper reel that is being formed.

As a whole, by means of the method according to the invention for reeling up, it is possible to implement a reeling process in such a manner that

- the torque of the drive of the primary surface drive device of the paper reel can be substantially set merely according to the tension requirements of the paper web before the reel-up, wherein the measurement information on the tension of the paper web is transferred to a control computer in real time, and the torque of the drive in the primary surface drive device of the paper reel is adjusted on the basis of this measurement information. This partial adjustment can be implemented without paying attention to the manner in which it will affect the density and other properties of the paper reel that is being formed, and
- the tension of the paper web between the paper layers inside the paper reel that is being formed is adjusted by controlling the other drives affecting the paper reel in relation to the torque of the drive of the surface drive device, wherein both the tension of the paper web before the reeling up stage and the tension of the paper reeled on the paper reel can be optimised comprehensively in real time in the reeling process.

BRIEF DESCRIPTION OF THE DRAWING

In the following description the invention will be illustrated in more detail with reference to the appended drawing which shows a schematical side-view of a reel-up applying the reeling up process according to the method.

DETAILED DESCRIPTION OF THE INVENTION

With reference to the drawing, the reel-up applying the method comprises a frame 1, on the support of which a reeling cylinder 2 functioning as a primary surface drive device is mounted on bearings, said reeling cylinder being equipped with an actuator 3, advantageously with a centre-drive. The reeling cylinder 2 is in nip contact N1 with a paper reel 5 formed on a reeling core 4, wherein the paper web PR is guided to the reeling cylinder 2 for example from the drying section of the paper machine or from the machine calender. The reeling core 4 is equipped with a centre-drive 6, and it is coupled to a reeling carriage 8 to move on rails K on the support of jaws 7 or the like, the reeling carriage 8 being provided with horizontal reeling carriage guides 9 in the machine frame to move the centre boss of the paper reel 5 that is being formed away from the reeling cylinder 2 when the formation of the paper reel proceeds, maintaining, however, the nip contact N1. Between the frame 1 and the reeling carriage 8 there is a horizontal loading device, such as a loading cylinder 10 to produce a nip load N1 between the reeling cylinder 2 and the reel 5 that is being formed. A second device 11 is also fixed on the frame 1 to move along with the paper reel 5 that is being formed and to produce a nip load N2, said device being in the presented embodiment e.g. a surface drive device or a supporting nip comprising two rolls 12 and 13 which are equal in width with the paper reel and arranged horizontally within a distance from each other, and between them there is a belt assembly 15 functioning by means of an actuator 14 arranged in connection with the roll 12. Before the reeling cylinder 2 in the travel direction of the paper web PR there is a tension meter 16.

The above-described reel-up assembly is coupled in the following way to a control and adjustment apparatus 17, i.e. a so-called CPU unit functioning as a control computer.

The tension meter 16 provides the tension measurement information of the paper web PR for the control and adjustment apparatus 17 along a line 18 illustrated by means of dotted lines. The obtained tension measurement information is utilized to adjust the torque produced by means of the control and adjustment apparatus 17 with the actuators 3 of the reeling cylinder 2 (line 19). Thus, the first stage of the invention entails the measurement of the web tension by means of the tension meter 16 before the reeling cylinder and using this measurement information as a control variable for the torque produced by means of the reeling cylinder 2. The torque $M_{rs}$ produced by the actuator 3 of the reeling cylinder is selected to be smaller than the sum $\Sigma M_i$ of the torque values produced by other actuators driving the paper reel 5.

In practise, the process according to the basic idea of the invention means that the torque values produced by the actuators affecting the inner properties of the paper reel formed on the reeling core are selected by using the torque produced by the actuator 3 of the reeling cylinder 2 with the equation $$M_i(n)=f(M_{rs}(n)), \text{ in which} \quad (1)$$

i=1 . . . k $M_i$=torque of, a given actuator affecting the inner properties of the paper reel, n=variable, and $M_{rs}$=torque produced by the actuator 3 of the reeling cylinder 2.

In the embodiment shown in the drawing i=2, in such a way that $M_1$=torque produced by the actuator 6 of the reeling core 4, and $M_2$=torque produced by the actuator 14 located in the surface drive device 11 or the like.

The line controlling the torque $M_1$ is shown with the reference numeral 20, and the line controlling the torque $M_2$ with the reference numeral 22. In the drawing, the lines 20 and 22 are shown as dotted lines connected to the control and adjustment apparatus 17. The drawing also shows an adjustment line 21 between the loading cylinder 10 and the control and adjustment apparatus 17. The magnitude of the nip contact N1 is adjusted via the control line 21.

In practise, the above-presented torque equation indicates that the control and adjustment unit 17 in connection with the reel-up applying the method is experimentally and/or calculatorily provided with a control algorithm by means of which the reeling up is adjusted comprehensively with optimisation purposes. Thus, the control algorithm has the following general format:

$$ST(n)=f(RK_e(n), RK_r(n)), \text{ in which} \quad (2)$$

n=variable,

ST(n)=optimising control algorithm, $RK_e(n)$=tension of the paper web PR before the reeling cylinder 2, and $RK_r(n)$=tension of the paper web PR reeled on the reeling core 4.

In the above-presented control algorithm ST(n) the tension $RK_e(n)$ of the paper web before the reeling cylinder 2 is produced by means of the torque $M_{rs}$ attained by means of the actuator 3 of the reeling cylinder 2 in the following way:

$$RK_e(n)=f(M_{rs}(n)), \text{ in which} \quad (3)$$

n=variable, $RK_e(n)$=tension of the paper web PR before the reeling cylinder 2, and $M_{rs}$=torque attained by means of the actuator 3 of the reeling cylinder 2.

Correspondingly, in the control algorithm ST(n) the tension $RK_r(n)$ of the paper web reeled or formed on the reeling core 4 is produced in the following way:

$$RK_r(n)_i=f(M_i(n)), \text{ in which} \quad (4)$$

i=1 . . . k, n=variable, $RK_r(n)_i$=effect of a given actuator on the tension of the paper web reeled on the reeling core, and $M_i$=torque of a given actuator affecting the inner properties of the paper web, wherein $$RK_r(n)=\Sigma RK_r(n)_i, \text{ in which} \quad (5)$$

$RK_r(n)$=tension of the paper web PR reeled on the reeling core 4.

In the reeling up according to the method, it is an important option that the torque $M_{rs}$ produced by the actuator 3 of the reeling cylinder 2 is adjusted by utilizing the prevention of access of air between the layers of paper web in the paper reel 5 formed on the reeling core 4 as at least one criteria for selecting said torque.

In the method, the mutual effect of the torque $M_{rs}$ effected by the actuator 3 of the reeling cylinder 2 and the actuator, so-called nip load device effecting the nip load Ni in the following way:

$$f(M_{rs}(n), M_{nk}(n))_{max}<PM_k, \text{ in which} \quad (6)$$

subindex max=the maximum value of the function f, n variable, $M_{rs}$=torque produced by the actuator 3 of the reeling cylinder 2, $M_{nk}$=torque produced by the nip load device 10, and $PM_k$=force based on friction and generated between the paper layers in the paper reel 5 formed on the reeling core.

The rotating force PV of the paper reel 5 formed on the reeling core 4 is controlled in the following way:

$$PV_i=f(M_i(n)), \text{ in which} \quad (7)$$

n=variable, i=1 . . . k, $PV_i$=rotating force produced by a given actuator, and $M_i$=torque of a given actuator affecting the inner properties of the paper reel, wherein $$PV=\Sigma PV_i, \text{ in which} \quad (8)$$

PV=total rotating force.

It is obvious for anyone skilled in the art that in the term $M_i$ the value of the subindex i can comply with the embodiment in question, unlike in the above-presented embodiments in which i=2.

The variable n can be a variable of time, speed of the paper web, grammage of the paper web, diameter of the paper reel, or a corresponding variable either alone or as a combination of two variables. Thus, the variable n used in the formulas 1 to 7, determines the torque values in such a manner that said torque is a function of the variables which are at least approximately dependent on the actual reeling process.

What is claimed is:

1. Method for reeling up, in which a paper web is continuously reeled on a reeling core, comprising the steps of:

controlling the formation of the paper reel at least by means of an actuator (6) of the reeling core (4), in the form of a centre-drive, an actuator (3) of a primary surface drive device (2) of the paper reel, and a nip load (N1) effective between the outer perimeter of a paper reel (5) formed on the reeling core (4) and the outer perimeter of the primary surface drive device (2) of the paper reel, said nip load being produced by means of an actuator (10), in the form of a nip load device and selecting the torque ($M_{rs}$) produced by the actuator (3) of the primary surface drive device (2) of the paper reel smaller than the sum ($\Sigma M_i$) of the torque values produced by the other actuators driving the paper reel that is being formed.

2. Method according to claim 1, wherein the torque ($M_{rs}$) produced by the actuator (3) of the primary surface drive device (2) of the paper reel is set according to a tension requirement of the paper web (PR) preceding the reeling up stage.

3. Method according to claim 1, wherein the web tension before the primary surface drive device (2) of the paper reel is measured and the measurement information is used as a control variable for the torque ($M_{rs}$) produced by means of the primary surface drive device (2) of the paper reel.

4. Method according to claim 1, wherein the torque values produced by the actuators affecting the inner properties of the paper reel (5) formed on the reeling core (4) are selected by using the torque ($M_{rs}$) produced by the actuator (3) of the primary surface drive device (2) of the paper reel with the equation:

$$M_i(n)=f(M_{rs}(n)), \text{ in which} \quad (1)$$

I=1 . . . k $M_i$=torque of a given actuator affecting the inner properties of the paper reel, n=variable, and $M_{rs}$=torque produced by the actuator (3) of the reeling cylinder (2).

5. Method according to claim 1, wherein a control and adjustment unit (17) included in the apparatus applying the method is provided with a control algorithm by means of which the reeling up is adjusted comprehensively with optimization purposes, wherein control algorithm has the following general format:

$$ST(n)=f(RK_e(n), RK_r(n)), \text{ in which} \quad (2)$$

n=variable,

ST(n)=optimizing control algorithm, $RK_e$(n)=tension of the paper web PR before the reeling cylinder (2), and $RK_r$(n)=tension of the paper web PR reeled on the reeling core (4).

6. Method according to claim 5, wherein in the control algorithm (ST(n)) ($RK_e$(n)) is produced by means of the torque ($M_{rs}$) attained by means of the actuator (3) of the reeling cylinder (2) in the following way:

$$RK_e(n)=f(M_{rs}(n)), \text{ in which} \quad (3)$$

n=variable $RK_e$(n)=tension of the paper web (PR) before the reeling cylinder (2), and $M_{rs}$=torque attained by means of the actuator (3) of the reeling cylinder (2).

7. Method according to claim 5, wherein in the control algorithm (ST(n)) ($RK_r$(n)) is produced in the following way:

$$RK_r(n)_I=f(M_i(n)), \text{ in which} \quad (4)$$

I=1 . . . k, n=variable, $RK_r(n)_I$=effect of a given actuator on the tension of the paper web reeled on the reeling core (4), and $M_i$=torque of a given actuator affecting the inner properties of the paper web, wherein $$RK_r(n)=\Sigma RK_r(n)_I, \text{ in which} \quad (5)$$

$RK_r$(n)=tension of the paper web (PR) reeled on the reeling core (4).

8. Method according to claim 1, wherein the torque ($M_{rs}$) produced by the actuator of the primary surface drive device of the paper reel is adjusted by using the prevention of access of air between the layers of paper web in the paper reel formed on the reeling core as at least one criteria for selecting the torque ($M_{rs}$).

9. Method according to claim 1, wherein a rotating force of the paper reel (5) formed on the reeling core, (4) is controlled in the following way:

$$PV_i=f(M_i(n)), \text{ in which} \quad (7)$$

n=variable,

I=1 . . . k, $PV_i$=rotating force produced by a given actuator, and $M_i$=torque of a given actuator affecting the inner properties of the paper reel, wherein $$PV=\Sigma PV_i, \text{ in which} \quad (8)$$

PV=total rotating force.

10. Method according to claim 4, wherein the variable n is at least one of the following variables: time, speed of the paper web, grammage of the paper web and/or the diameter of the paper web.

* * * * *